United States Patent [19]

Chierici

[11] 4,079,842

[45] Mar. 21, 1978

[54] UNCOUPLING DEVICE FOR ROTARY DUMP CARS

[75] Inventor: Osvaldo F. Chierici, Elmhurst, Ill.

[73] Assignee: Holland Company, Lombard, Ill.

[21] Appl. No.: 815,493

[22] Filed: Jul. 14, 1977

[51] Int. Cl.[2] ..... B61G 3/08

[52] U.S. Cl. ..... 213/166; 213/146

[58] Field of Search ..... 213/75 R, 115, 159, 213/161, 146, 166, 167, 168, 169, 170, 211, 219

[56] References Cited

U.S. PATENT DOCUMENTS

| | | | |
|---|---|---|---|
| 2,836,307 | 5/1958 | Wolfe | 213/166 |
| 3,572,518 | 3/1971 | Wisler | 213/166 |
| 3,580,400 | 5/1971 | DePenti | 213/166 |
| 3,834,553 | 9/1974 | DePenti | 213/166 |

*Primary Examiner*—Trygve M. Blix
*Assistant Examiner*—Jesus D. Sotelo
*Attorney, Agent, or Firm*—McWilliams & Mann

[57] ABSTRACT

An uncoupling device for rotary dump cars in which the car couplers are of the bottom operating type, wherein at each end of the car the uncoupling mechanism is made of the same type, and comprising both the rotary and non-rotary couplers of the car being equipped with paddle type lock lifters having a pivotal operating stroke that unlocks and opens the coupler knuckle, and a bail type actuator therefor, wherein the actuator comprises a bail member mounted on the end of the car to receive the center sill and swing about a horizontal axis extending crosswise of the car and located at approximately the level of the top of the car center sill and adjacent its striker. The bail member has a striker section that underlies the center sill and is equipped with a paddle striker that is arced to accommodate coupler side swing. The uncoupling device includes a handle structure journaled on the end of the car to have a cranking axis that is adjacent to but below the level of the car center line of draft and connected to the bail member through a lost motion, camming type connection to swing same to bring the bail member striker into striking engagement with the paddle, to thereby move the paddle through its full operating stroke to unlock and open the coupler knuckle. The bail member is spring-biased to a retracted position spaced from the paddle and disposed under the center sill striker.

8 Claims, 3 Drawing Figures

FIG. 1
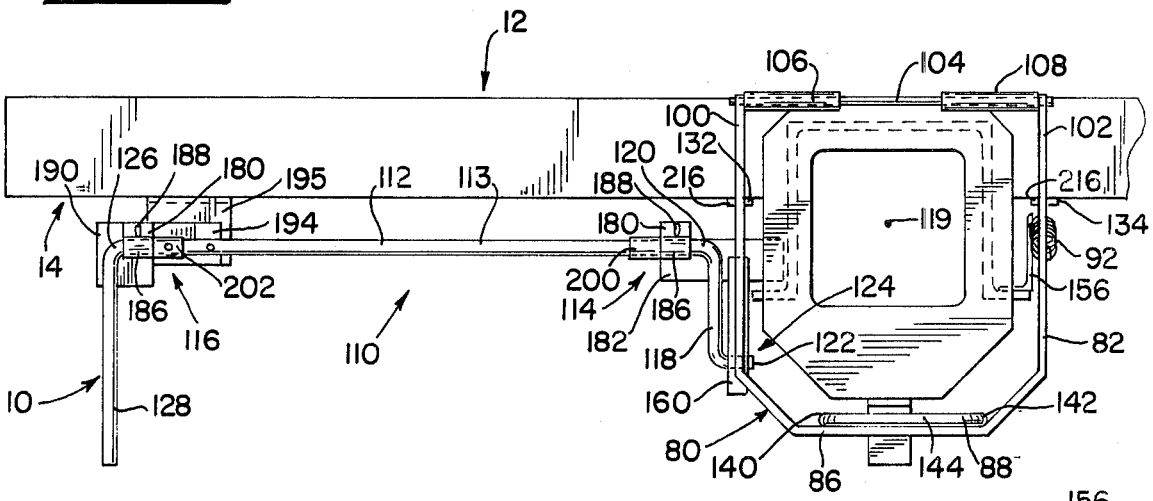
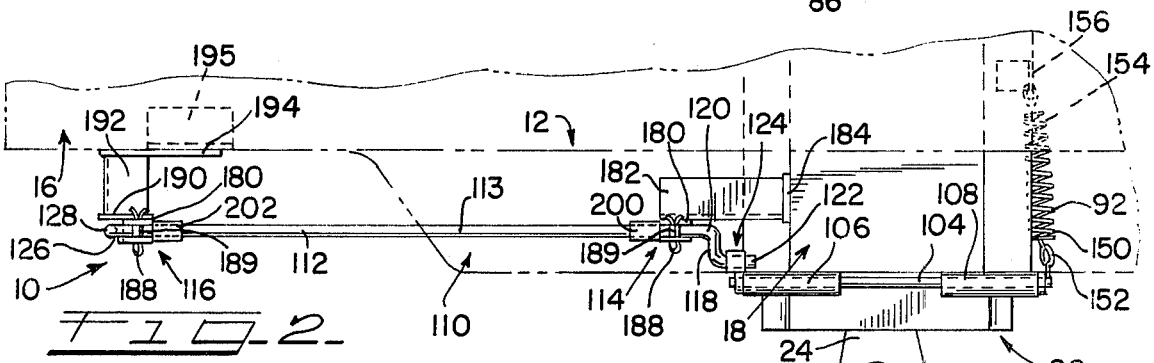
FIG. 2
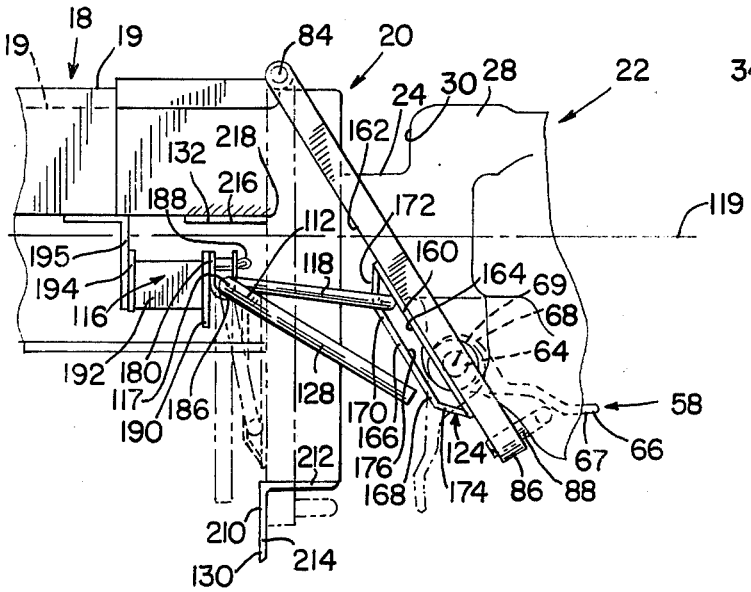
FIG. 3

UNCOUPLING DEVICE FOR ROTARY DUMP CARS

This application discloses an improvement in my application Ser. No. 662,588, filed Mar. 1, 1976, now U.S. Pat. No. 4,047,619, the disclosure of which is incorporated herein by this reference.

This invention relates to an uncoupling arrangement for railroad cars of the rotary dump type, and more particularly, to an uncoupling arrangement or device for bottom operated rotary and non-rotary couplers, with which rotary dump cars are conventionally equipped.

Railroad cars of the rotary dump type, which are finding increasing use in the so-called unit trains, conventionally are arranged to permit the dumping of each car by the controlled tilting of same while the car is still connected in the train. For this purpose, cars of this type are equipped with a rotary coupler at the "A" end of the car, and a non-rotary coupler at the "B" end of the car, with both couplers usually being of the bottom operated type.

The rotary coupler at the A end of the car is conventionally equipped with an uncoupling device mounted on the car body but having no physical connection with the coupler head. A familiar form of uncoupling device of this type is the so-called bail type uncoupling rod assembly involving a bail member pivotally mounted on the car, usually on the end sill, and arranged to strike a paddle that is an integral part of the coupler lock lifter.

At the B end of the car, the coupler is equipped with an uncoupling device involving an operating rod that is physically connected to the coupler lock lifter.

Existing coupling arrangements of this type have presented a number of difficulties to the railroads. For instance, the operating lever or rod for the rotary coupler that operates the bail, and the bail itself, have a rather inefficient leverage relationship with respect to the coupler lock lifter that all too frequently results in the coupler unlocking mechanism being only partially operated, with consequent difficulty in uncoupling the car. The uncoupling rods for the coupler at the B end of the car have similar lever relationship inefficiencies, and in addition, the coupler at the B end of the car is frequently arranged to be operated from either side of the car by equipping the coupler with a double eye lock lifter rotor, and uncoupling rod assemblies extending to either side of the car, which are frequently of right and left hand character; thus their parts cannot be made in duplicate, meaning that three separate types of uncoupling assemblies are required for such cars with corresponding complications in inventory requirements and attendant expense.

Another problem with conventional uncoupling arrangements for rotary dump cars is that the relatively low level of positioning of the operating rods employed creates interference problems with the car wheels and trainline connections, and also exposes the operating rods to damage when passed coupler impacts are occasioned.

A principal object of the present invention is to provide an uncoupling arrangement for rotary dump cars which insures that the coupler knuckle of the couplers at both ends of the car will both be unlocked and opened (and thus "popped") when the car is to be uncoupled.

Another principal object of the invention is to provide an uncoupling arrangement for rotary dump cars that permits the use of the same type of uncoupling device at both ends of the car.

Another important object of the invention is to arrange the uncoupling assembly at each end of the car to be free of interference with the car wheels and trainline connections, improve access to the trainline connections, and avoid the possibility of operating rod damage due to passed coupler impacts.

Still other objects of the invention are to provide an uncoupler arrangement for rotary dump cars that is inexpensive of manufacture, that is easy to install and service, that simplifies inventory requirements, and that is long lived in operation.

In accordance with the present invention, an uncoupling device is provided that may be applied to both ends of the rotary dump car, and comprises the coupler being equipped with a paddle type lock lifter having a pivotal operating stroke that both unlocks and fully opens the coupler knuckle, and a bail type actuator therefor, wherein the actuator comprises a bail member mounted on the end of the car to swing about a horizontal axis that extends crosswise of the car and is located at approximately the level of the top of the car center sill for increased operational leverage relationships with respect to the lock lifter. The bail member has a striker section equipped with a paddle striker that is arced to accommodate coupler side swing whereby the uncoupling device operates efficiently independent of the positioning of the coupler head sidewise of the car in the normal coupler side swing pattern. The uncoupling device includes a handle structure comprising an operating rod or lever journaled on the end of the car to have an axis of swinging movement that is below but adjacent the level of the car centerline of draft, and connected to the bail member by a lost motion camming type connection to swing the latter to bring its striker into striking engagement with the coupler paddle and move the coupler paddle through its full operating stroke with an operating stroke of the handle of approximately 60°. The bail member is spring biased to a retracted position spaced from the paddle and disposed under the center sill striker.

At the present time, rotary couplers at the A end of the car are commonly equipped with a paddle type lock lifter with which the invention is adapted to cooperate. At the B end of the car, it is contemplated, as disclosed in said application, that the rotary lock lifter conventionally employed will be replaced by a paddle type lock lifter whereby the coupler carried uncoupling means will be functionally similar to that of the rotary coupler at the other end of the car. With this change, the B end of the car may be equipped with an uncoupling device of the present invention.

Where it is desired that, at either end of the car, the car be arranged to uncouple the car from either side of the car, the operating rod or lever of this invention and its connection to the bail member may be merely duplicated on either side of the car, with two sets of the operating rods being mounted to extend to the respective sides of the car, at each end of the car.

Other objects, uses, and advantages will be obvious or become apparent from a consideration of the following detailed description and the application drawings.

In the drawings:

FIG. 1 is a fragmental end view of a railroad car equipped with a preferred embodiment of the invention;

FIG. 2 is a top plan view of the structure shown in FIG. 1, with the coupler being shown; and FIG. 3 is a side elevational view taken substantially from the left hand side of FIG. 2, showing the bail member of the present invention in multiposition form, indicating its operational path of movement, and that of the coupler paddle, when the coupler is to be uncoupled.

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Reference numeral 10 generally indicates a preferred embodiment of the invention applied to end sill 12 of rotary dump car 14 that is equipped with the usual underframe 16 including conventional center sill 18 that protrudes from either end of the underframe 14 and is equipped with conventional coupler striker 20 (these parts being shown largely in block diagram form and partially in phantom).

The coupler 22 is operably mounted in the center sill in any conventional manner, and in accordance with conventional practices, the coupler shank 24 is operably connected to the center sill and/or the car body 14 through a conventional type of draft gear mechanism, an example of which is shown in U.S. Pat. No. 2,811,263, whereby the car is equipped for standard draft gear cushioning of coupler impacts applied to the coupler.

As is well known in the art, the car body 14 is supported on the railroad track by suitable trucks (not shown), and the shank 24 of the coupler is secured to the car for swinging movement to either side of the car longitudinal center line. In cars of the rotary dump type, the coupler at either end of the car conventionally has a 13° angle side swing capability to either side of the car longitudinal center line.

The specific coupler 22 that is illustrated is intended to represent an AAR type F interlocking coupler comprising the coupler head 26 and the coupler shank 24. The coupler head 26 is provided on its upper side with the customary horn 28 having the usual rearwardly facing buffing surface 30 and abuts against the striker 20 to limit inward buffing movement of the car. Coupler 22 also has the usual knuckle 32 swingably mounted on the coupler head by pivot pin 34.

As disclosed in said application Ser. No. 662,588, the coupler head 26 includes lock lifter 58 and associated parts to effect opening of knuckle 32.

The lock lifter 58 is rotatably mounted on the coupler head on pivot pin 64 for rotation about a horizontal axis 69 and in a vertical plane paralleling the longitudinal center line of the coupler and within the usual coupler head passageway between the coupler head spaced side walls defining same. The pivot pin 64 spans the said head passageway and is suitably secured in place as by employing a cotter pin or the like.

Counterclockwise rotation of the lock lifter 58 about its pivot pin 64 (viewed as shown in FIG. 3) from its normal position to the position indicated in FIG. 3 (approximately 85°) operates to effect full opening of the knuckle 32, all as is well known in the art, and as disclosed in said application.

In accordance with the invention of said application, the couplers at both the A and the B end of the car are equipped with the lock lifter assembly linkage disclosed in said application, and the lock lifter 58 is of the type shown in U.S. Pat. No. 3,834,553, and thus includes operating arm 66, often referred to in the railroad field as the "paddle". In the normal rest position of the lock lifter 58, as indicated in said application, the paddle or operating arm 66 extends vertically downwardly of the lock lifter hub portion 68 (see FIG. 3) under the weight of the components of the lock lifter linkage that rest on the lock lifter lever arm (not shown).

While the rotary coupler of rotary dump cars are conventionally equipped with a paddle type lock lifter arrangement of the general type referred to, the non-rotable coupler at the B end of the car ordinarily is not. In accordance with the invention of said application, the conventional rotary lever of such couplers (which is located at the position of pivot pin 64) is removed and replaced by a lock lifter 58 having the aforementioned paddle 66.

In accordance with the present invention, uncoupling device 10 comprises paddle actuator 80 comprising bail member 82 of U-shaped configuration disposed on either side of the center sill 18 and mounted for pivotal movement about a horizontal axis 84 extending transversely of the car and located adjacent the level of the top 19 of the center sill 18. Bail member 82 has a central striker portion 86 equipped with a paddle striker 88 of the special configuration disclosed in said application, and adapted to engage the paddle 66 to swing the lock lifter 58 between its normal depending dashed line riding position through to the generally horizontal position of FIG. 3, in which the coupler knuckle is both unlocked and swung to its fully opened position. As indicated, this involves a swinging movement on the part of the lock lifter of 85°, at which point the lock lifter paddle 66 engages the coupler safety support shelf (not shown but see said application).

The bail member 82 is biased to the dashed retracted position of FIG. 3 by a tension spring 92 acting between the bail member 82 and the center sill 18.

In the form shown, the bail member 82 is mounted for pivotal or swinging movement about axis 84 by having its legs 100 and 102 fixed to suitable cross rod 104 that is in turn journalled in the respective tubular members 106 and 108 that are suitably fixed to the car coaxially of the axis 84, as by being welded or otherwise affixed to the car end sill or other appropriate car body structure that disposes the tubular members 106 and 108 at the location indicated in the drawings, wherein the bail member 82 in its retracted position is in substantially coplanar relation with the striker 20 and in its extended position effects the positioning of the paddle 66 that is indicated in FIG. 3.

Operably associated with bail member 82 is handle structure 110 that comprises operating rod 112 having a control rectilinear portion 113 journalled on the car by bearing devices 114 and 116 for pivotal movement about crank or pivot axis 117 that is adjacent to but below the level of the car center line of draft, indicated at 119. Operating rod 112 is a one piece component having a swing or crank arm 118 integral therewith at its inboard end 120 that is disposed generally perpendicular to the axis 117 and terminates in a cam portion 122 that is in substantial parallel relation to the axis 117 and has a lost motion camming connection with bail member 82 at a camming slideway or slot 124, to swing the bail member 82 by a prying type of camming action between its retracted and extended positions indicated in FIG. 3.

Rod 112 also includes at its outboard end 126 rectilinear hand grip portion 128 that is perpendicular to the axis 117 and that is grasped by the operator to operate the device 10.

The operating rod 112 has its crank arm portion 118 and its hand grip portion 128 oriented such that in the retracted position of the bail member 82, the hand grip portion 128 is vertically disposed and the crank end portion 118 makes the flat angled relationship with the bail member 82 that is indicated in FIG. 3 (which may be in the range of 10°–20°. The camming slideway 124 extends in parallelism with the leg 100 of the bail member 82 from adjacent its striker portion along approximately the lowest one third of the leg 100 and up to approximately level of the axis 117 (with reference to the retracted position of the bail member that is indicated in FIG. 3).

Operably associated with the device 10 is bail member locator 130 that is fixed to the underside of striker 20 and a pair of stop plates 132 and 134 suitably fixed to the car in alignment with the respective bail member legs 100 and 102, as indicated in FIG. 1. The spring 92 acts to bias the bail member 82 to its retracted position as defined by locator 130, that serves to properly index the striker in its retracted position for proper riding and initial operating stroke position relative to lock lifter 58, stops 132 and 134, comprise stop means for the bail member to protect locator 130, and specifically its indexing position relative to the lock lifters 58.

As indicated, a device 10 is applied both to the A end and the B end of the car, following the disclosure of said application. When the couplers involved are not equipped with the paddle type lock lifter that has been disclosed, the coupler is modified to be so equipped, and, of course, this is simply done by removing the existing lock lifter and applying the commercially available paddle type lock lifter 58 in its place.

As indicated in FIG. 3, in the normal riding position of the device 10, the bail member 82 and its paddle striker 88 are disposed in spaced relation from the coupler paddle 86 (which is the retracted position of the bail member). The bail member is therefore physically separated from the coupler lock lifter 58 and rotates with the car body underframe when the car is tilted for dumping same.

When the car is to be uncoupled, the operator grasps the operating rod hand grip portion 128 and swings same counterclockwise of FIG. 3, from the broken line position to the full line position (approximately 60°), during the course of which stroke the bail member striker is swung against the coupler paddle rearward surface 67 and then the coupler paddle swung to the uncoupled position of FIG. 3.

SPECIFIC DESCRIPTION

The bail member 82, in accordance with said application, is preferably formed from bar stock of rectangular transverse cross-sectional configuration, with the U-shaped configuration of the bail member being such that the long dimension of the indicated transverse cross-sectional configuration parallels the plane of bail member 82.

The bail member striker 88 is formed from round bar stock to define the U-shaped configuration disclosed in said application, having its legs 140 and 142 suitably affixed, as by welding, to the bight portion 86 of the bail member 82. The striker legs 140 and 142 merge into bight portion 144 that is of the rounded configuration disclosed in said application in conformance with the side swing of the coupler (bight portion 144 of striker 88 is thus struck on an arc centered at the point of pivotal swing of the coupler 22). In the form shown, the striker 88 is applied to the bail member 82 to be centered relative to the paddle 66 and the arcuate shaping of the striker bight portion insures that irregardless of the position of the coupler relative to the striker 88, when the striker contacts the paddle surface 67, the contacting portion of the striker will be tangent to the paddle surface 67 (as disclosed in said application).

The tension spring 92 is connected between the bail member 82 and the center sill 18 by having one of its ends 150 suitably secured to suitable linkage 152 anchored in the leg 102 of the bail member 82 at approximately the level of axis 117 (see FIG. 1), and its other end 154 suitably secured to angle bracket 156 that is suitably anchored to the center sill 18.

The bail member camming slideway 124 comprises a base plate 160 fixed to the bail member leg 100 on its narrow side 162 that faces the car. Plate 160 parallels the plane of the bail member 82 and defines planar cam surface 164. Fixed in spaced relation to the plate 160 is keeper member 166 in the form of plate or bar 168 having a main body portion 170 paralleling the plate or bar 160 and end portions 172 and 174 angled for connection to the ends of the plate or bar 160, whereby the plates or bars 160 and 166 define the slideway or cam way 124 that parallels the plane of the bail member 82. The body portion 1700 of plate 160 defines cam surface 176 that parallels and opposes cam surface 164. It will be noted that the slide or cam way 124 is disposed along the lower half of the bail member 82 and extends upwardly from its bight portion 86 to approximately the level of the crank axis 117. The slide or cam way 176 is also disposed on the back or car facing side of the bail member 82, rather than being formed in the bail member leg 100, which retains the basic strength of the bail member, and provides some reinforcement for it by way of the presence of the bars 160 and 166. The operating rod 112 that has a camming type lost motion connection with bail member 82 whereby the operating rod 112 in being used to actuate bail member 82 exerts a prying type camming action on the lower portion of the bail member 82 to swing it through its operating stroke with minimum effort.

The bearing device 114 comprises an open U member 180 disposed in upright position and fixed in place by being welded to angle member 182 that is in turn fixed to mounting bracket plate 184 suitably fixed to the center sill, as by welding. The end 120 of operating rod 110 rests in the bight portion 186 of the U member 180, and suitable cotter pin 188 is applied between the legs of the U member 180 to removably secure the operating rod thereto (preferably through sleeve 189).

The bearing device 116 comprises a similar U member 180 fixed as by welding to mounting plate 190 that in the form shown is suitably fixed to angle member 192 that is in turn fixed to mounting plate 194 which is suitably fixed to the car end sill 12 (as by being fixed to angle member 195 that is in turn suitably fixed to the car). The end 126 of operating rod 110 rests in the bight portion 186 of the U member 180 with which it is associated, a cotter pin 188 securing same in operating position.

Sleeves 200 and 202 applied to the operating rod 110 are welded in place in substantial abutting relation with the respective U members 180 to maintain the operating rod 110 against movement lengthwise of its rectilinear portion 113.

The bail member locator 130 comprises angle member 210 having its flange portion 212 suitably welded to the underside of the striker 20 and its flange portion 214 vertically disposed to serve as an indexor type stop for the bail member striker portion 86.

The stops 132 and 134 comprise plates 216 suitably fixed to the car and having their ends 218 disposed to be engaged by the respective legs 110 and 102 of the bail member. As the bail member axis 84 may be at any convenient position longitudinally of the center sill 12 between the car body end sill and the striker for any given application, plates 216 are mounted in position after bail member 82 and locator 130 are mounted in position. As indicated, plates 216 serve as fixed stops against which the bail member 82 is returned, by the action of spring 92 and gravity, to protect locator 130 from displacement from its indicating location.

The device 10 not only provides an uncoupling arrangement for rotary dump cars which not only insures that the coupler knuckle will be fully opened on each operation of the uncoupling device, but also permits the use of the same type of uncoupling device at each end of the car, following the disclosure of said application.

Furthermore, the device 10 is arranged so that the bail member 82 effects the full 85° movement stroke of the coupler paddle 66 by a swinging motion on the order of 30° effected by a swinging movement of the operating rod 112 on the order of 60° between the two positions indicated in FIG. 3.

Furthermore, the upward swinging action induced on the bail member 82 is by way of a camming action of the operating rod cam portion 122 riding on cam plate 160 that provides a prying type camming action on the bail member easily inducing its movement from the vertically disposed retracted position of FIG. 3 to the extended operative angled full line position shown in FIG. 3, against the biasing action of tension spring 92, and the weight of the lower end of the bail member 82 and the coupler parts operated by same. On release, the weight of the bail member and the portions 118 and 128 of the operating rod, together with the biasing action of spring 92, return the uncoupling device parts to the retracted position of FIG. 3, the operating rod 112 being cammed from its extended operating position toward its retracted position by the camming action of plate 160 on the rod cam portion 122.

The uncoupling lever arrangement provides a distinct mechanical advantage in operation through the engagement of the bail member by operating rod cam portion adjacent the lower end of the bail member, as compared to operating rod arrangements of a conventional nature that require that the movement of the bail member be effected by the operating rod operating about and being connected to the bail member in alignment with axis 84.

Further, the operator, using operating rod 112, at the point of contact with paddle 66, starts the movement of paddle 66 without also having to oppose the full action of gravity on the mass of bail member 82, as the operating rod 112 operates the bail through the indicated lost motion connection at slideway 124, rather than having to swing the bail member by direct connection to same at the level of axis 84. The operating momentum established when the bail member contacts paddle 66 permits full follow through to the bail member fully extended position with an easy swinging type cranking action applied to operating rod handle 128.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scop of the invention.

I claim:

1. In a railroad car having a body including a center sill projecting from one end of the car and equipped with a coupler striker and a bottom operating coupler mounted on the center sill, with the coupler being mounted for swinging movement sidewise of the car and including a pivotal lock lifter having a depending paddle for actuating the lock lifter to uncouple the coupler, with the lock lifter having a pivotal operating stroke to uncouple the coupler, and with the car having an uncoupling lever device at said end thereof, said device including an actuator pivotally mounted on the car and having a striker section underlying the center sill and positioned to be swung from under the center sill to strike the paddle to actuate the lock lifter, said center sill striker being disposed transversely of the center sill, and including a handle structure operatively secured to the actuator for pivoting the actuator to strike the paddle and pivot the lock lifter about its operating stroke, and means for spring biasing the actuator to a retracted position in which said striker section thereof is disposed in a retracted position under the center sill and spaced from the paddle, the improvement wherein:

the actuator is mounted on said end of the car body for making said pivotal movement about a horizontal axis that is disposed at a level adjacent that of the top of the center sill, said actuator comprising a bail member of substantially U-configuration defining a pair of legs separated by a bight portion that comprises said striker section, said bail member having its legs pivotally connected to the car to pivotally mount same thereon for providing said actuator pivotal movement about said axis with said legs being disposed to either side of said center sill and said bail member depending from the car, said handle structure comprising an operating rod journaled on the car for pivotal movement about a cranking axis that is below but adjacent the car centerline of draft and that substantially parallels said horizontal axis, said operating rod at its inboard end defining a depending crank arm disposed adjacent one of said bail member legs and defining a camming portion, said one bail member leg being formed to define a cam follower slot extending longitudinally thereof in which said crank arm camming portion is received in camming relation thereto, said slot extending from adjacent said bail member bight portion toward the level of said horizontal axis, said operating rod at its outboard end defining a depending handle for swinging said rod about said cranking axis, said operating rod crank arm and handle being oriented such that when said actuator is in its retracted position, said operating rod handle is vertically disposed and said operating rod camming position is disposed adjacent the lower end of said bail member slot, said bail member, when said actuator is in its said retracted position, projecting below the level of said cranking axis to define a free swinging actuator end portion that projects below said level of said cranking axis, whereby when said handle is moved to swing said actuator striker section to strike the paddle, the operating rod camming portion moves said bail member from the actuator retracted position to strike the paddle and move the lock lifter through its operating stroke by camming said projecting end portion of said bail member endwise of the car through said operating rod camming portion moving lengthwise of said slot in cranking relation to said bail member projecting end portion.

2. The improvement set forth in claim 1 wherein:

said operating rod crank arm and handle are oriented such that a swinging movement of said operating rod about said cranking axis to move said lock lifter through its operating cycle approximates 60°.

3. The improvement set forth in claim 1 wherein:

said bail member end portion in said retracted position of said bail member is vertically aligned with said striker, and including locator means fixed to said striker against which said spring means biases said bail member to locate same in its said retracted position.

4. The improvement set forth in claim 3 wherein:

said operating rod depending handle is vertically disposed when said bail member is in its said retracted position.

5. The improvement set forth in claim 3 wherein:

said cranking axis is spaced from said bail member horizontal pivot axis inwardly of the car longitudinally of said sill.

6. The improvement set forth in claim 3 including:

stop means fixed to said car against which said bail member legs abut in said retracted position of said bail member, said stop means comprising:

a pair of stop members fixed to said car respectively aligned with the respective legs of said bail member and positioned above the car centerline of draft.

7. The improvement set forth in claim 6 wherein said locator means comprises:

a stop member fixed to the underside of said striker below said centerline of draft for engagement by said bail member bight portion.

8. The improvement set forth in claim 3 wherein:

said operating rod crank arm and handle and said bail member are oriented such that a swinging movement of said operating rod about said cranking axis to move said lock lifter through its operating cycle approximates 60° to thereby swing the bail member on the order of about 30°.

* * * * *